US012275581B2

(12) United States Patent
Leven et al.

(10) Patent No.: US 12,275,581 B2
(45) Date of Patent: Apr. 15, 2025

(54) TRANSPORT CONTAINER FOR A TEMPERATURE-CONTROLLED TRANSPORT OF TEMPERATURE-SENSITIVE GOODS

(71) Applicant: va-Q-tec AG, Würzburg (DE)

(72) Inventors: Johannes Leven, Zellingen (DE); Fabian Eschenbach, Rottendorf (DE); Joachim Kuhn, Würzburg (DE); Markus Gorran, Retzstadt (DE)

(73) Assignee: va-Q-tec AG, Würzburg (DE)

( * ) Notice: Subject to any disclaimer, the term of this patent is extended or adjusted under 35 U.S.C. 154(b) by 54 days.

(21) Appl. No.: 18/041,353

(22) PCT Filed: Jul. 30, 2021

(86) PCT No.: PCT/DE2021/100659
§ 371 (c)(1),
(2) Date: Feb. 10, 2023

(87) PCT Pub. No.: WO2022/033628
PCT Pub. Date: Feb. 17, 2022

(65) Prior Publication Data

US 2023/0356928 A1 Nov. 9, 2023

(30) Foreign Application Priority Data

Aug. 12, 2020 (DE) ..... 20 2020 104 675.6

(51) Int. Cl.
*B65D 88/74* (2006.01)
*F25D 3/06* (2006.01)

(52) U.S. Cl.
CPC ..... *B65D 88/744* (2013.01); *F25D 3/06* (2013.01); *F25D 2303/08221* (2013.01)

(58) Field of Classification Search
CPC ..... B65D 88/744; F25D 2303/082; F25D 2303/08221; F25D 2303/083; F25D 3/06
(Continued)

(56) References Cited

U.S. PATENT DOCUMENTS 11,629,911 B2 * 4/2023 Kuhn ..... B65D 81/18 62/79
2007/0051734 A1 * 3/2007 Kuhn ..... F25D 3/06 220/592.27
2007/0289976 A1 * 12/2007 Meyer ..... F25D 17/06 220/592.09

FOREIGN PATENT DOCUMENTS

CN 105658538 B * 10/2017 ..... B65D 81/02
DE 202018104807 U1 8/2018
(Continued)

*Primary Examiner* — Nathan J Jenness
*Assistant Examiner* — Madison L Poos
(74) *Attorney, Agent, or Firm* — Mark Terry

(57) ABSTRACT

Transport container 1 for temperature-controlled transport of temperature-sensitive goods, comprising a container wall 2 which, in a closed state, completely encloses an interior space 3, the container wall 2 comprising three side wall elements 21*a*, 21*b*, 21*c*, a top element 22, a base element 23 and a door element 24, which door element 24 can be arranged on the transport container 1 in such a way as to completely close an opening 10 of the transport container 1, and wherein at least one receiving strip 4 is arranged on each of the three side wall elements 21*a*, 21*b*, 21*c* in such a way as to attach temperature storage elements 5 thereto, and wherein on at least one of the side wall elements 21*a*; 21*c*, a receiving frame 6 with at least one receiving strip 4 for the attachment of temperature storage elements 5 is movably arranged in such a way that, in the closed state of the transport container 1, the opening is at least partially covered and, in an open state of the transport container 1, the opening 10 is completely uncovered.

13 Claims, 3 Drawing Sheets

(58) Field of Classification Search
USPC ..... 220/1.5
See application file for complete search history.

(56) References Cited

FOREIGN PATENT DOCUMENTS

| | | | | | |
|---|---|---|---|---|---|
| DE | 202018106306 | U1 | | 11/2018 | |
| EP | 2876389 | B1 | | 1/2018 | |
| GB | 2543047 | A | | 4/2017 | |
| GB | 2604152 | A | * | 8/2022 | ..... B65D 81/38 |
| JP | 2019043649 | A | | 3/2019 | |
| KR | 101617639 | B1 | * | 5/2016 | |
| KR | 101739430 | B1 | * | 5/2017 | |
| WO | 2004104498 | A2 | | 12/2004 | |

* cited by examiner

TRANSPORT CONTAINER FOR A TEMPERATURE-CONTROLLED TRANSPORT OF TEMPERATURE-SENSITIVE GOODS

The invention relates to a transport container for temperature-controlled transport of temperature-sensitive goods according to the independent claim.

Due to the use of vacuum insulation elements for thermal insulation, transport containers of this kind are very suitable in practice, especially in the field of passively temperature-controlled transports.

In temperature-controlled transport of temperature-sensitive goods, a predetermined temperature range is maintained during the transport period. This predetermined temperature range can be selected according to the type of goods to be transported, such as food, beverages, pharmaceutical products or medical products.

Passive temperature control here includes the use of additional temperature storage elements such as PCM (phase changing material), melt storage elements or dry ice. The advantage of using such temperature storage elements is that no energy source is required for cooling (heating) the temperature-sensitive goods during transport, and that the transport temperature can be kept within a predetermined range without the use of external or internal cooling and/or heating units.

In the prior art, the European patent with publication number EP 2 876 389 B1 and the German utility model DE 20 2018 104 807 U1 are known, both of which protecting vacuum insulation containers in the form of a transport container for passively temperature-controlled transport. Such a transport container has three side wall elements, a top element, a base element and at least one door element. The door element can be pivoted about a vertical axis. In the interior, rail-like receptacles are attached to the side walls, into which the melt storage elements are inserted for transport. Such transport containers can be provided in different sizes depending on the desired transport volume.

Furthermore, GB 2 543 047 A and JP 2019-43 649 A are known.

It has been found that when large-volume transport containers are used, for example, for transporting goods in aircraft, which can accommodate one or two transport pallets, the rail-like receptacles for receiving temperature storage elements arranged in the side walls alone are not sufficient to ensure adequate cooling. Furthermore, it is problematic with regard to the homogeneity of the temperature distribution that the temperature storage elements are arranged on only three sides.

It is the object of the invention to provide a transport container which overcomes the disadvantages in the prior art and, in particular, ensures a homogeneous temperature distribution in the interior and ensures the arrangement of a large number of melt storage elements.

This object is attained by a transport container according to claim 1. Advantageous aspects of the invention form the subject matter of the respective subclaims.

The invention comprises a transport container for temperature-controlled transport of goods. The transport container comprises a container wall which, in the closed state, completely encloses an interior space. The container wall comprises three side wall elements, a top element, a base element and a door element. The door element can be arranged on the transport container in such a way as to completely close an opening to the interior of the transport container. At least one receiving strip is arranged on each of the three side wall elements in such a way that temperature storage elements can be attached thereto. On at least one of the side wall elements adjacent to the opening, a (single) receiving frame with at least one receiving strip for attaching temperature storage elements is movably (e.g. pivotably) arranged in such a way that in a closed state of the transport container the opening is at least partially covered and in an open state of the transport container the opening is completely uncovered (over the entire cross-section of the interior space). Due to the receiving frame in the area of the opening to the interior, temperature storage elements can be arranged on the door side to enable homogeneous temperature distribution. Since temperature storage elements can also be arranged in the area of the door element in this way, the total number of temperature storage elements arranged can be increased.

According to an advantageous technical aspect, the door element is arranged via at least a first hinge on a first side wall element adjacent to the opening. The receiving frame is arranged via at least a second hinge on a second side wall element adjacent to the opening and opposite the first side wall element. In this way, the door element and the receiving frame can be pivoted in different directions for opening, whereby the opening angle of the receiving frame is not restricted by the door element. This also ensures a stable standing of the opened transport container.

Advantageously, the transport container further comprises at least one guide strip which is arranged in the interior space in such a way as to extend substantially straight from the opening of the transport container to a side of the container wall opposite the opening. The at least one guide strip has a cross-section widening towards the side of the container wall opposite the opening. In this way, a transport item inserted into the transport container, such as a transport cage for liquid containers, is secured against slipping in the rear part and, at the same time, can be easily inserted into the interior in the larger front area of the opening.

Preferably, a wedge strip rising towards the interior space is arranged on the side of the base element facing the opening. The wedge strip can be designed in such a way that when the door element is moved (e.g. pivoted) into a closed state of the transport container, the door element does not jam with the lower part of the opening. The wedge strip can also provide a rising sliding surface that facilitates the insertion of a transport item, such as a transport cage for liquid containers.

It is particularly advantageous if a first locking arrangement is arranged on the door element, which is designed in such a way as to lock the door element against the base element and/or the top element. The first locking arrangement can be designed in such a way that it does not protrude beyond the side wall elements.

It is particularly advantageous if at least one second locking arrangement is arranged on the door element, which is designed so as to lock the door element against at least one of the side wall elements adjacent to the opening. In this regard, each locking arrangement may be configured so as not to protrude beyond the sidewall elements.

According to a further advantageous aspect, each locking arrangement comprises a respective actuating element, wherein each of the actuating elements is arranged on the door element. In this regard, the actuating elements may be in the form of handles.

It is preferred if at least one spacer element is arranged on one of the sides of the base element opposite the interior space (respectively on an outer surface) for resting on a forklift boom of a forklift truck. The spacer element can be one (preferably three) metal sheet(s) fastened transversely to the insertion direction of the transport tine and having a thickness of more than 1 mm.

Particularly preferably, the receiving strips comprise substantially an L-shaped or U-shaped stop for the attachment of temperature storage elements.

In this technical aspect, it is preferred if the stop comprises at least one recess. At the location of the recess, a clamping element is adjustably attachable (e.g., foldably or displaceably) to the receiving strip such that, in a first position, the recess is exposed and, in a second position, the recess is at least partially covered. In this way, the temperature storage elements can be arrested in the receiving strips in order to secure them against falling out, for example, in the event of movements occurring during transport.

Preferably, at least one guide sheet embedded into or mounted onto the base element is arranged on the side of the base element facing the opening. To reduce wear due to the frequent impact contacts with the transport tines of a forklift truck at this location, the guide sheet is advantageous. In this case, the guide sheet can be embedded into or mounted onto the base element in such a way that the guide sheet protrudes at least partially from the base element, thereby further reducing the wear due to the frequent impact contacts with the transport tines of a forklift truck at this location.

It is also advantageous if at least one stop element is arranged on the third side wall element opposite the opening in such a way that a transport item inserted into the transport container is spaced against the third side wall element opposite the opening. A transport item inserted into the interior space, such as a transport cage for liquid containers, abuts against the stop element in the fully inserted state.

Particularly preferably, the transport container further comprises a locking element. The locking element is arranged in the interior space in such a way as to lock a transport item inserted into the transport container against removal from the transport container. For this purpose, the locking element can be designed as a rotary lever preloaded by means of a spring, one end of which abuts against the inserted transport item in order to hold it in position by means of the spring force.

In the following, the transport container according to the invention for temperature-controlled transport of temperature-sensitive goods will be explained in more detail with reference to the examples shown in the accompanying drawings. Identical reference signs refer to the same features in all figures.

Figure 1:
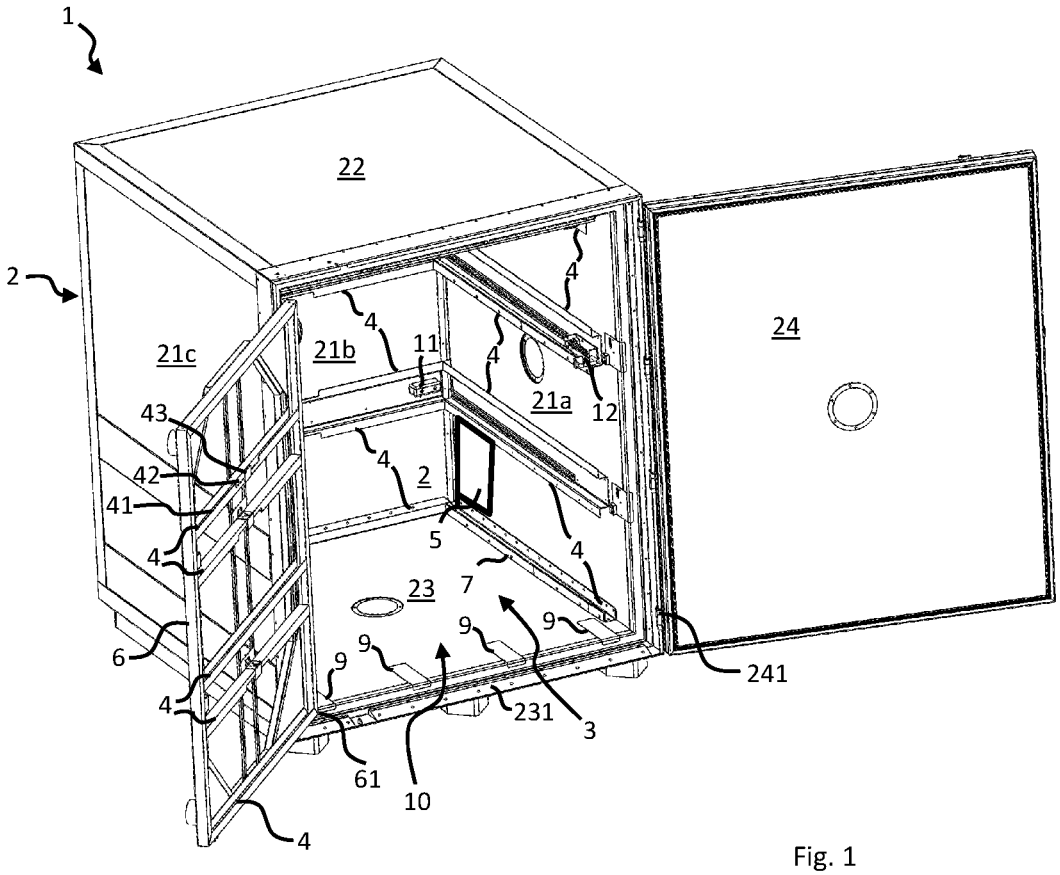
FIG. 1 shows a perspective view of an opened transport container.

The transport container 1 for temperature-controlled transport of temperature-sensitive goods is shown in FIG. 1 in a perspective view from the front. In the open state shown, it can be seen that no goods to be transported are arranged in the interior space.

The transport container 1 shown has a cubic container wall 2 which can completely hermetically enclose an interior space 3. The container wall 2 has three side wall elements 21*a*, 21*b*, 21*c* each connected to each other on one side, which in turn are each connected to a top element 22 on one side. A base element 23 is arranged on the opposite side, so that a square opening 10 is formed which can be closed by a door element 24.

The door element 24 is arranged so as to be pivotable about a vertical axis at the edge region of the right-hand side wall element 21*a* and, in a first position, completely covers the opening 10 and, in a second position, completely uncovers the opening 10 (entire circumference), so that a transport item whose circumference corresponds substantially to the circumference of the opening 10 can be inserted.

On all three side wall elements 21*a*, 21*b*, 21*c* there are attached a receiving strip 4 in the upper area, a receiving strip 4 in the lower area and two receiving strips 4 in the middle area. In the example shown, the receiving strips 4 have an L-shaped stop 41, the stops being arranged in such a way that temperature storage elements 5 can be inserted and displaced between them. The stop 41 has a recess 42 in the center which can be closed and uncovered by means of a clamping element 43.

A receiving frame 6 is pivotably arranged on the side wall element 21*c* adjacent to the opening 10 on the left. Four receiving strips 4 for attaching temperature storage elements 5 are arranged on the receiving frame 6 in the same way as in the side wall elements 21*a*, 21*b*, 21*c*. The receiving frame 6 can be pivoted about the connecting axis with side wall element 21*c* and completely covers the opening 10 in the pivoted-in state or completely uncovers the opening 10 in the pivoted-out state.

Due to the receiving frame 6 in the area of the opening 10 to the interior space 3, temperature storage elements 5 can be arranged on the door side to achieve a homogeneous temperature distribution. Temperature storage elements 5 can thus also be arranged in the area of the door element 24, so that the total number of arranged temperature storage elements is increased.

In the example shown, the door element 24 is attached to the right-hand side wall element 21*a* via four hinges 241. The receiving frame 6 is attached to the opposite side wall element 21*c*.

In the present embodiment, a guide strip 7 can be seen in the lower region. The guide strip 7 is arranged to extend substantially from the opening 10 of the transport container 1 to the rear container wall 2. The at least one guide strip 7 has a cross-section which widens towards the rear in the direction of the interior space.

On the side of the base element 23 facing the opening 10, a wedge strip 231 rising towards the interior space 3 is arranged. The wedge strip 231 is designed in such a way that the door element 24 does not jam when being closed.

A stop element 11 is arranged on the third side wall element 21*b* opposite the opening 10, against which a transport item introduced into the transport container 1 can be brought into abutment.

Furthermore, the transport container 1 comprises a locking element 12, which is arranged on the side wall element 21*a*, and a further locking element 12 (not shown), which is arranged on the side wall element 21*c*, with which a transport item can be locked against removal from the transport container 1.

Furthermore, in the example shown, at least one guide sheet 9 mounted onto the base element 23 of the transport container 1 is arranged on the side of the base element 23 facing the opening 10. The guide sheet 9 is mounted here in such a way that the guide sheet 9 partially protrudes from the base element 23, thereby reducing wear due to frequent impact contacts with the transport tines of a forklift truck at this location.

Figure 2:
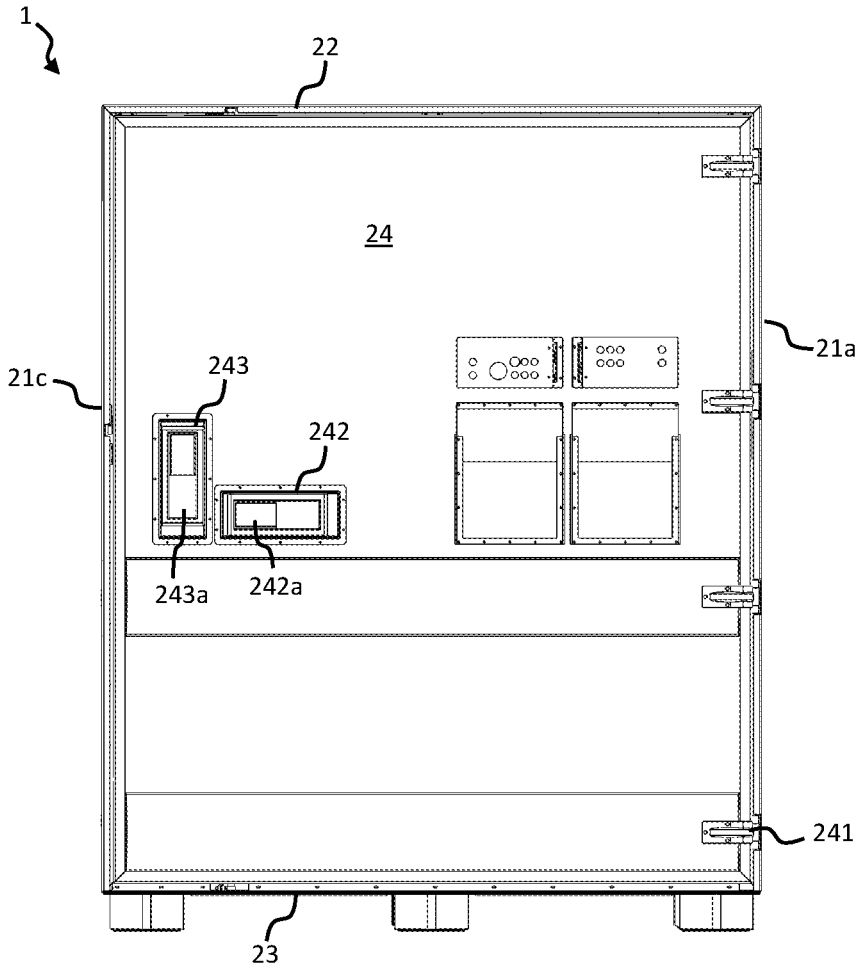
FIG. 2 shows a front view of a closed transport container shown in FIG. 1.

In FIG. 2, the transport container 1 is shown from the front with the door element 24 in the closed state.

The door element 24 is pivotally attached to the side wall element 21*a* by means of four hinges 241. A first locking arrangement 242 is disposed on the door element 24 for locking the door element 24 against the base element 23 and the top element 22 by twisting a locking bar (not shown) with engagement hooks (not shown) to get into engagement at the base element 23 and the top element 22.

Also disposed on the door element 24 is a second locking arrangement 243 that locks the door element 24 against the side wall element 21*c* adjacent to the opening (see FIG. 1).

Each of the locking arrangements 242, 243 is configured so as not to protrude beyond the side wall elements 21*a*, 21*c*.

Each locking arrangement 242, 243 comprises a respective actuating element 242*a*, 243*a* designed as a handle, which are arranged on the door element 24. An advantage of this arrangement of the actuating elements 242*a*, 243*a* is that several transport containers 1 can be placed close to each other adjacent to the side wall elements 21*a*, 21*c* without restricting the opening and closing of the actuating elements 242*a*, 243*a*.

Figure 3:
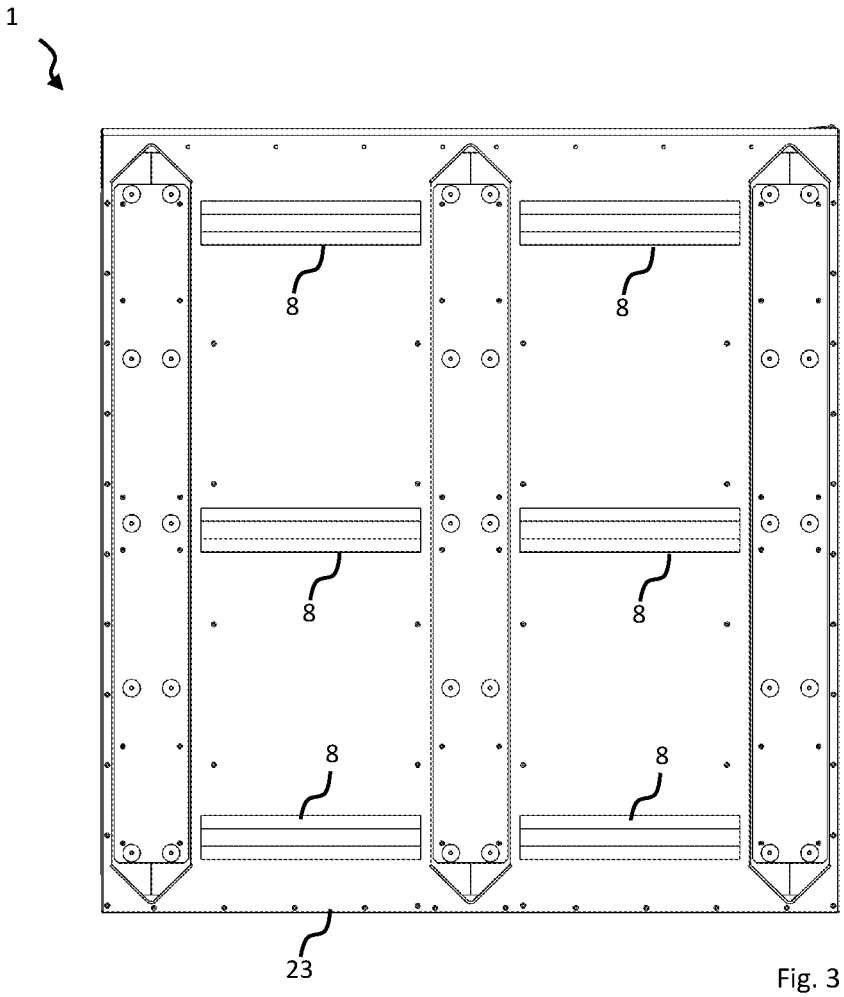
FIG. 3 shows a view from below onto the transport container shown in FIG. 1 and FIG. 2.

In FIG. 3, the underside of the transport container 1 is shown. On one of the sides of the base element 23 opposite the interior space (see FIG. 1), six spacer elements 8 are arranged for resting on a forklift boom of a forklift truck.

The invention claimed is:

1. A transport container for temperature-controlled transport of temperature-sensitive goods, comprising a container wall which, in a closed state, completely encloses an interior space, the container wall comprising three side wall elements, a top element, a base element and a door element, which door element can be arranged on the transport container in such a way as to completely close an opening of the transport container, and wherein at least one receiving strip is arranged on each of the three side wall elements in such a way as to attach temperature storage elements thereto, and wherein on at least one of the side wall elements adjacent to the opening a receiving frame with at least one receiving strip for the attachment of temperature storage elements is movably arranged in such a way that, in the closed state of the transport container, the opening is at least partially covered and, in an open state of the transport container, the opening is completely uncovered.

2. The transport container according to claim 1, wherein the door element is arranged via at least one first hinge on a first side wall element of the three side wall elements adjacent to the opening, and wherein the receiving frame is arranged via at least one second hinge on a second side wall element of the three side wall elements adjacent to the opening and opposite the first side wall element.

3. The transport container according to claim 1, comprising at least one guide strip, which is arranged in the interior space in such a way as to extend substantially straight from the opening of the transport container to a side of the container wall opposite the opening, and wherein the at least one guide strip has a cross-section widening towards the side of the container wall opposite the opening.

4. The transport container according to claim 1, wherein a wedge strip rising towards the interior space is arranged on the side of the base element facing the opening.

5. The transport container according to claim 1, wherein a first locking arrangement is arranged on the door element, which is designed in such a way as to lock the door element against the base element and/or the top element.

6. The transport container according to claim 5, wherein at least a second locking arrangement is arranged on the door element, which is designed in such a way as to lock the door element against at least one of the side wall elements adjacent to the opening.

7. The transport container according to claim 6, wherein each locking arrangement comprises a respective actuating element, wherein each of the actuating elements is arranged on the door element.

8. The transport container according to claim 1, wherein at least one spacer element is arranged on one sides of the base element opposite the interior space for resting on a forklift boom of a forklift truck.

9. The transport container according to claim 1, wherein the receiving strips have substantially an L-shaped or U-shaped stop for the attachment of temperature storage elements.

10. The transport container according to claim 9, wherein the L-shaped or U-shaped stop has at least one recess, and wherein a clamping element is displaceably attached to the receiving strip at the at least one recess in such a way that, in a first position, the at least one recess is exposed and, in a second position, the at least one recess is at least partially covered.

11. The transport container according to claim 1, wherein at least one guide sheet embedded into or mounted onto the base element is arranged on a side of the base element facing the opening.

12. The transport container according to claim 1, wherein at least one stop element is arranged on the third side wall element of the three side wall elements opposite the opening in such a way that a transport item introduced into the transport container is spaced against the third side wall element opposite the opening.

13. The transport container according to claim 1, comprising a locking element which is arranged in the interior space in such a way as to lock a transport item introduced into the transport container against removal from the transport container.

* * * * *